US005124031A

United States Patent [19]

Dallmer

[11] Patent Number: 5,124,031

[45] Date of Patent: Jun. 23, 1992

[54] SURFACE DRAIN FOR A TILED FLOOR

[75] Inventor: Johannes Dallmer, Arnsberg, Fed. Rep. of Germany

[73] Assignee: Dallmer GmbH & Co., Arnsberg, Fed. Rep. of Germany

[21] Appl. No.: 613,523

[22] PCT Filed: Jan. 12, 1990

[86] PCT No.: PCT/EP90/00160

§ 371 Date: Nov. 7, 1990

§ 102(e) Date: Nov. 7, 1990

[87] PCT Pub. No.: WO90/10761

PCT Pub. Date: Sep. 20, 1990

[30] Foreign Application Priority Data

Mar. 10, 1989 [DE] Fed. Rep. of Germany ..... 3907832

[51] Int. Cl.[5] ..... E03F 5/04

[52] U.S. Cl. ..... 210/164; 210/232; 210/459; 137/362

[58] Field of Search ..... 210/163, 164, 165, 459, 210/232; 404/2, 25, 26; 405/36; 137/362

[56] References Cited

U.S. PATENT DOCUMENTS 1,730,455 10/1929 Glauber .
4,978,250 12/1990 Dallmer ..... 210/164

FOREIGN PATENT DOCUMENTS 1287524 1/1969 Fed. Rep. of Germany .
2945749 5/1981 Fed. Rep. of Germany .
8706377 11/1987 Fed. Rep. of Germany .
7714600 8/1979 Sweden ..... 210/164

*Primary Examiner*—W. Gary Jones
*Attorney, Agent, or Firm*—Henry M. Feiereisen

[57] ABSTRACT

The surface drain has a cup-shaped drain body (14) which is securely cast into a concrete slab (10). A cylindrical inset (20) in form of a disk is fitted in the concrete slab and rotatable about the axis of the drain body. Fitted in the disk is also a rotatable cylindrical part (31) of a square frame (30) which receives a grate. When laying the tiles, the square sides of the grate frame can be set parallel to the joints of the tiles by turning the grate frame. Since the cylindrical inset (20) has an eccentric inner cylinder (24) for receiving the cylinder (31), a turning of the cylindrical inset in the concrete slab permits the square sides of the grate to coincide with the coordinates of the tile joints.

6 Claims, 2 Drawing Sheets

SURFACE DRAIN FOR A TILED FLOOR

The invention refers to a surface drain for a tiled floor according to the features set forth in the preamble of the main claim.

Surface drains of this type are permanently installed. When laying the tiles upon the plaster floor, the inset, which supports a grate frame, can be turned so that the sides of this grate frame can be set parallel to the tiles, with the cup-shaped drain body being positioned such that the sides of the grate frame are oriented as far as possible in a same alignment as the joints of the tiles or at least in immediate proximity thereto. Practice has shown that the connection between the tiles and the grate frame is primarily attained by suitably cut strips. In view thereof, the object of the invention is as follows:

A surface drain of the above-stated type is to be designed in such a manner that at approximately correct positioning of the drain body in the raw floor during laying of the tiles, a precise alignment of the grate frame with the course of the tile joints is accomplished. This object is attained in principle by a surface drain according to the features of the main claim. The dependent claims relate to preferred embodiments and alternate designs.

In conventional surface drains, as utilized for example in residential buildings, the eccentricity of the cylindrical inset may amount to e.g. 20 mm. Thus, the distance of one frame side relative to the wall of the drain body is smaller than the distance of the opposing frame side. By respectively turning the cylindrical inset, the frame sides increasingly approach the coordinates of the joint line, and in general a turning position can be obtained in which the joint line is matched. In this case, the use of suitably cut tile pieces becomes unnecessary.

According to a preferred embodiment of the invention, the grate frame, too, is provided with an eccentricity between the axis of the square frame and the axis of the attached cylinder. During parallel setting of the frame sides, a further adjustment can be achieved by turning the grate frame by 90° or 180°, respectively.

Moreover, the invention refers to the application of the principal solution in a surface drain of particular type in which the cup-shaped drain body is cast in a concrete slab which in turn is cast in the raw structure. The cylindrical inset is designed as flat disk, with its surface extending essentially flush with the surface of the concrete slab.

The principal solution may also be applied in a conventional drain body of plastic material which is directly cast in the raw floor, with the eccentric cylinder being attached to a conventional, relatively high inset, which is cuttable to size, for receiving the grate frame.

The following description refers to exemplified embodiments of the invention, with reference to the drawings, in which.

Figure 4:
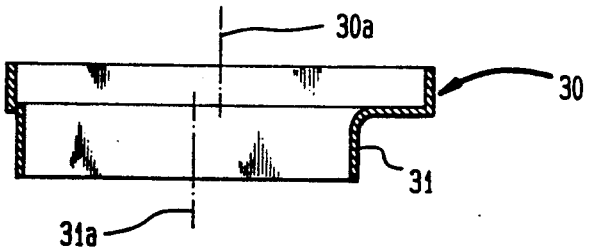
FIG. 4 is a section through a pertaining grate frame.
Figure 3:
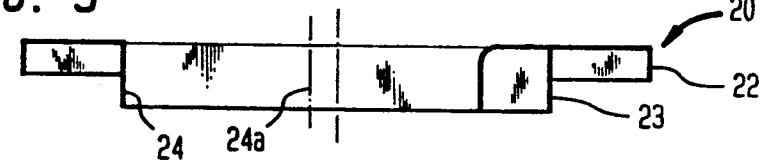
FIG. 3 shows a radial section through a pertaining cylindrical inset.

The surface drain according to FIGS. 1 to 4 is of special design and includes a cup-shaped drain body 14 of plastic material which is known per se and cast in a square slab 10 of polyester concrete. The concrete slab 10 is cast in the raw floor and includes an upper cylinder 12 and a lower cylinder 13 which extend concentrically to the axis 11. Both cylinders are provided for rotatably receiving a cylindrical inset 20 which is configured in form of a disk and includes complementary to the cylindrical surfaces of the concrete slab an upper outer cylinder 22 and a lower outer cylinder 23. The flat surface of the disk extends essentially flush with the surface of the concrete slab. The disk 20 is further provided with an inner cylinder 24 which is defined by an axis 24*a* extending eccentrically to the axis 11 of the drain body by e.g. 20 mm.

The purpose of the eccentric inner cylinder 24 of the disk-shaped inset 20 is to rotatably receive a grate frame 30, that is a cylinder 31 which is part of the square grate frame and is defined by an axis 31*a*. The axis 30*a* of the square frame is also defined by an eccentricity of e.g. 10+10mm relative to the axis 31*a* of the attached cylinder 31.

Figure 2:
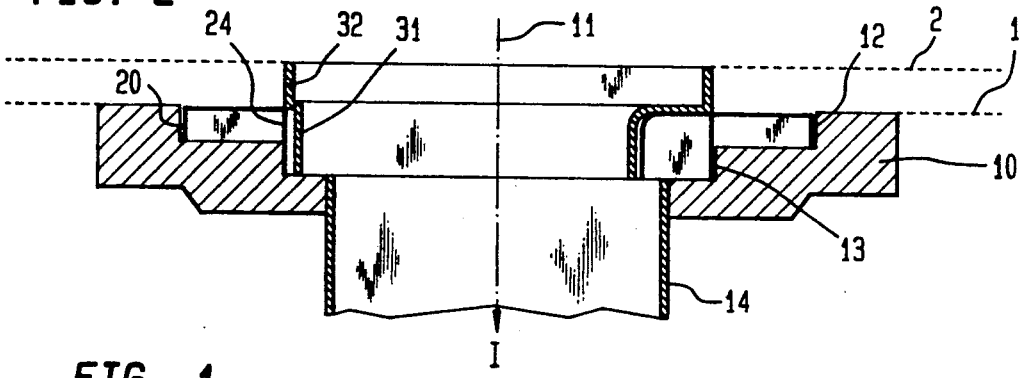
FIG. 2 is a section taken along II-II of FIG. 1.
Figure 1:
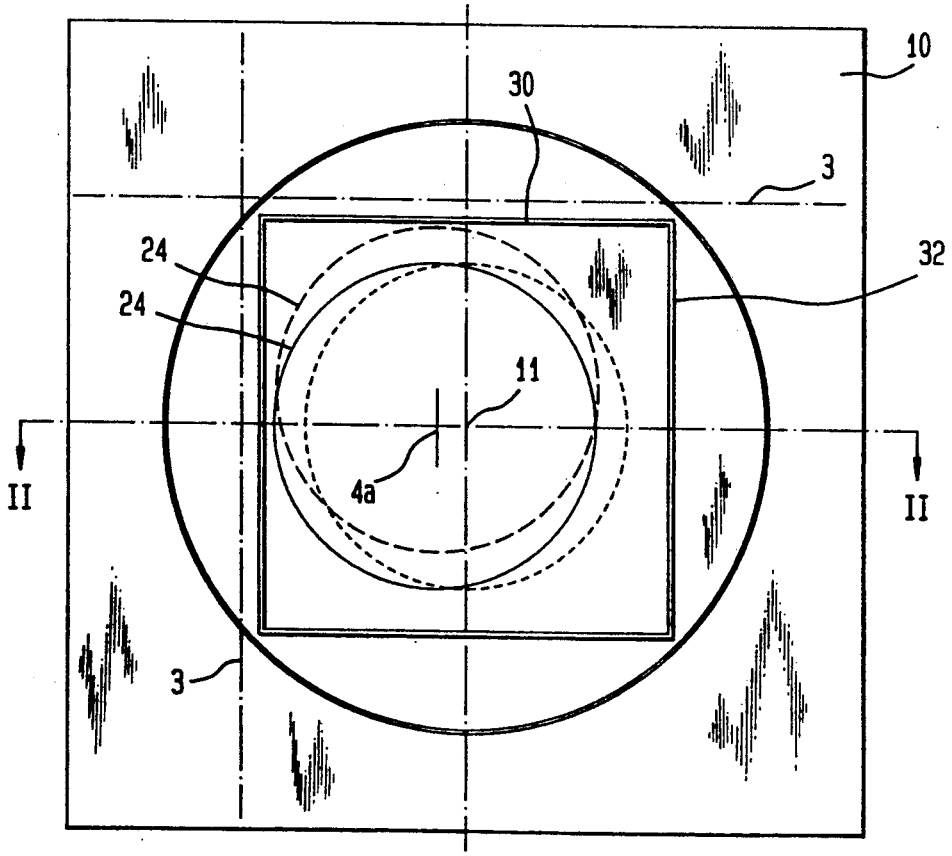
FIG. 1 shows a plan view of a surface drain according to the invention.

In FIG. 2, 1 designates the surface of the concrete floor, 2 designates the surfaces of the tiles which together with the square grate frame 30 define a plane. In FIG. 1, lines 3 illustrate the course of the joints of the floor tiles. In FIG. 1, the fully drawn lines illustrate the grate frame 30 which, however, is not matched yet to the course of the joint lines 3. The overlap between grate frame 30 and joint lines 3 can be accomplished by turning the disk 20 until the eccentric inner cylinder 24 coincides with the configuration indicated in broken lines.

Figure 5:
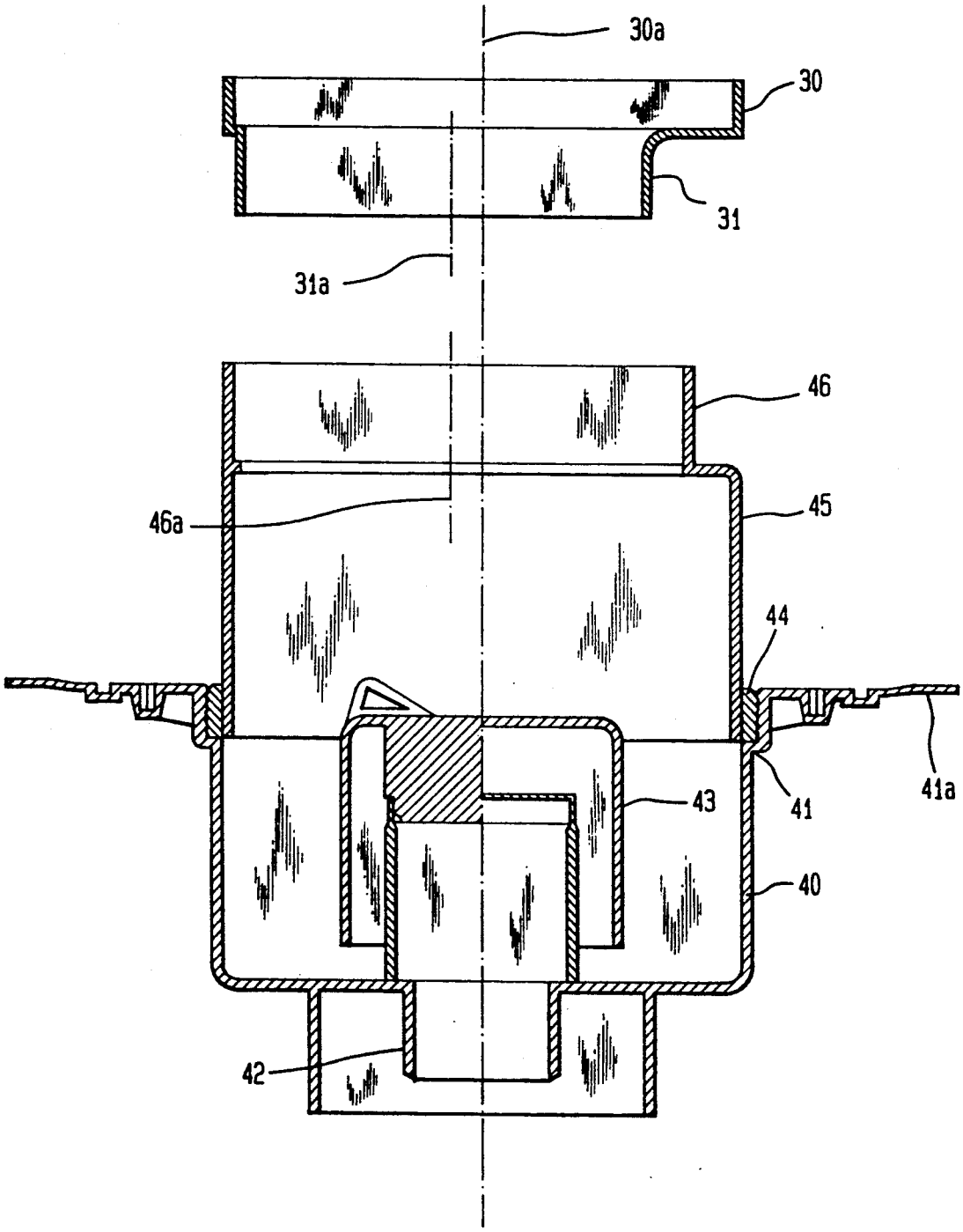
FIG. 5 shows in a vertical section the application of the invention in a conventional drain body.

The surface drain according to FIG. 5 includes a conventional cup-shaped drain body 40 of plastic material, with an integral shoulder 41 which is connected to a collar 41*a*. Connected to the bottom of the drain body is a drain pipe 42 which is enclosed by a bell 43 serving as drain trap. A relatively high cylindrical inset 45 of plastic material is rotatably, concentrically fitted in the drain body, with a sealing ring 44 interposed therebetween. The inset may be shortened as required Connected to the top of the inset is a cylinder 46 which is defined by an eccentric axis 46*a*and receives the cylinder 31 of the grate frame 30.

Instead of a grate, a ceramic element, which matches the tiles and includes an inlet funnel, may be mounted in the grate frame.

I claim:

1. A surface drain for a tiled floor, comprising:

a drain body (14) defining an axis (11);

an inset (20, 45) in axial alignment with the drain body (14) and being rotatable about the axis of the drain body, with the inset (20, 45) including an inner cylinder (24, 46) defining an axis (31*a*) extending eccentrically relative to the axis (11) of the drain body; and a grate frame (30) mounted in the cylinder (24, 46), with the grate frame (30) and the inset (20, 45) being separately rotatable for respectively providing an effective positional adjustment of the grate frame (30) relative to the tiles.

2. A surface drain according to claim 1 wherein the grate frame (30) defines an axis (30*a*) which extends essentially at a same eccentricity relative to the axis (31*a*) of the cylinder (31) as the axis (11) of the drain body.

3. A surface drain according to claim 1 wherein the drain body (14) is cast in a concrete slab (10) which includes in axial alignment with the drain body an upper cylinder (12) and a lower cylinder (13), wherein the inset (20) with the eccentric inner cylinder (24) has the configuration of a flat disk which is essentially flush with the concrete slab.

4. A surface drain according to claim 1 wherein the drain body (40) has a collar (41*a*), with a concentric inset (45), which is cuttable to size, being rotatably inserted in the drain body, wherein the inset (45) has a top which includes an eccentric cylinder (46) for receiving the grate frame.

5. A surface drain according to claim 1 wherein the grate frame (30) defines an axis (30*a*) which extends at an eccentricity relative to the axis (30*a*) of the cylinder (31).

6. A surface drain for a tiled floor, comprising:

a drain body (14) defining an axis (11);

an inset (20, 45) in axial alignment with the drain body (14) and being rotatable about the axis of the drain body, with the inset (20, 45) including an inner cylinder (24, 46) defining an axis (31*a*) extending eccentrically relative to the axis (11) of the drain body; and a grate frame (30) mounted in the cylinder (24, 46) and defining an axis (30*a*) which extends essentially at a same eccentricity relative to the axis (31*a*) of the cylinder (31) as the axis (11) of the drain body.

* * * * *